US011490206B1

(12) United States Patent
Hsu et al.

(10) Patent No.: US 11,490,206 B1
(45) Date of Patent: Nov. 1, 2022

(54) MICRO-SPEAKER AND DAMPER FOR MICRO-SPEAKERS

(71) Applicant: Vanson Electronics (Nanhai) Co., Ltd., Foshan (CN)

(72) Inventors: Ching-Shan Hsu, Taipei (TW); Hao-Chien Hsu, Taipei (TW)

(73) Assignee: Vanson Electronics (Nanhai) Co., Ltd., Foshan (CN)

( * ) Notice: Subject to any disclaimer, the term of this patent is extended or adjusted under 35 U.S.C. 154(b) by 0 days.

(21) Appl. No.: 17/515,560

(22) Filed: Nov. 1, 2021

(30) Foreign Application Priority Data

Sep. 27, 2021 (CN) ..... 202111135224.X

(51) Int. Cl.
*H04R 7/26* (2006.01)
*H04R 9/02* (2006.01)

(52) U.S. Cl.
CPC ..... *H04R 7/26* (2013.01); *H04R 9/025* (2013.01); *H04R 2400/11* (2013.01)

(58) Field of Classification Search
CPC ..... H04R 7/26; H04R 9/025; H04R 2400/11
See application file for complete search history.

(56) References Cited

U.S. PATENT DOCUMENTS

2007/0230738 A1* 10/2007 Royse ..... H04R 9/025 381/433
2020/0053478 A1* 2/2020 Liu ..... H04R 7/18
2021/0211820 A1* 7/2021 Lin ..... H04R 9/06

FOREIGN PATENT DOCUMENTS

CN 208908496 U * 5/2019 ..... H04R 1/06

* cited by examiner

*Primary Examiner* — Sunita Joshi
(74) *Attorney, Agent, or Firm* — Winston Hsu

(57) ABSTRACT

A micro-speaker includes a frame body, a diaphragm arranged on the frame body, a magnetic structure and a voice coil arranged in the frame body. An upper end of the voice coil is fixed to the diaphragm. The magnetic structure is arranged under the voice coil. A monolithic, one-piece voice-coil balancing system is fixed under the frame body. The monolithic, one-piece voice coil balancing system is composed of two symmetrically arranged dampers connected to an integrally formed support frame. The two dampers and the support frame are made of a flexible circuit board. Each of the two dampers comprises a first end, a second end and a cantilever connecting the first end and the second end. A ratio of a length L of the cantilever to a distribution distance D of the cantilever is between 2-15.

16 Claims, 5 Drawing Sheets

MICRO-SPEAKER AND DAMPER FOR MICRO-SPEAKERS

BACKGROUND OF THE INVENTION

1. Field of the Invention

The invention relates to the technical field of loudspeaker, in particular to a micro-speaker and a damper for micro-speakers.

2. Description of the Prior Art

A loudspeaker is a kind of transducer element that converts electrical signals into acoustic signals, and is an important acoustic component in electronic products. The speaker module usually includes a frame and a magnetic system and a vibration system disposed within the frame. The vibration system includes a diaphragm and a voice coil arranged under the diaphragm. The voice coil drives the diaphragm to produce sound under the vibration of the magnetic system.

With the high pursuit of portability of electronic products, reducing the size is a necessary goal when updating various micro-speaker products, but the reduction in volume means that the volume of the magnet of the micro-speaker must be reduced at the same time, resulting in a decrease in output of the sound. Increasing the power may compensate the decrease in output of the sound caused by the smaller magnet. However, the micro-speaker faces the risk of tearing the voice coil lead due to excessive amplitude.

SUMMARY OF THE INVENTION

It is one objective of the present invention to provide a micro-speaker and a damper for the micro-speaker, so as to solve the above-mentioned problems of the prior art.

In order to achieve the above objectives, the present disclosure provides the following technical solutions.

A micro-speaker includes a frame body, a diaphragm arranged on the frame body, a magnetic structure and a voice coil arranged in the frame body. An upper end of the voice coil is fixed to the diaphragm. The magnetic structure is arranged under the voice coil. A monolithic, one-piece voice-coil balancing system is fixed under the frame body. The monolithic, one-piece voice coil balancing system is composed of two symmetrically arranged dampers connected to an integrally formed support frame. The two dampers and the support frame are made of a flexible circuit board. Each of the two dampers comprises a first end, a second end and a cantilever connecting the first end and the second end. A ratio of a length L of the cantilever to a distribution distance D of the cantilever is between 2-15.

According to some embodiments, each of the two dampers has a left-right symmetrical structure.

According to some embodiments, the cantilever has no copper layer on a front side of each of the two dampers.

According to some embodiments, each of the two dampers comprises a substrate that is made of a polymer material.

According to some embodiments, a voice coil lead is fixed to a welding part of the first end on a front side of each of the two dampers by spot welding, which is electrically connected to a circuit on each of the two dampers and a connection terminal of the second end.

According to some embodiments, an external signal wire is welded to the connection terminal of the second end.

According to some embodiments, a width of the cantilever is 0.45 mm.

According to some embodiments, the diaphragm is arranged in a slender shape, and wherein a size of the diaphragm in a length direction is larger than a size in a width direction.

According to some embodiments, the frame body has an opening that matches a shape of the diaphragm, and the diaphragm is connected to the frame body through a ring-shaped surround to seal the opening.

According to some embodiments, the magnetic structure includes a main magnetic portion and a yoke under the main magnetic portion, and wherein a gap is located between the main magnetic portion and the yoke, and the voice coil is disposed around an outer periphery of the main magnetic portion and installed in the gap.

According to some embodiments, a washer for magnetic conduction is provided on the main magnetic portion.

According to some embodiments, a cross-section of the yoke has a U-shaped profile.

According to some embodiments, a length of the yoke is shorter than a length of the main magnetic portion, and a width of the yoke is greater than a width of the main magnetic portion.

According to some embodiments, the support frame is located outside the yoke.

According to some embodiments, the support frame is fixed under the frame with glue.

According to some embodiments, the support frame is fixed under the frame by insert injection molding.

According to some embodiments, the frame body is provided with positioning bolts, and the support frame is provided with corresponding alignment holes.

One advantage of the present invention is that the dampers and the support frame integrally constitute the monolithic, one-piece voice-coil balancing structure, so it is more convenient and simple to assemble, and the structure is more stable, so that the voice coil balancing performance can be further improved. In addition, embedded iron or metal parts on the frame body can be spared.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
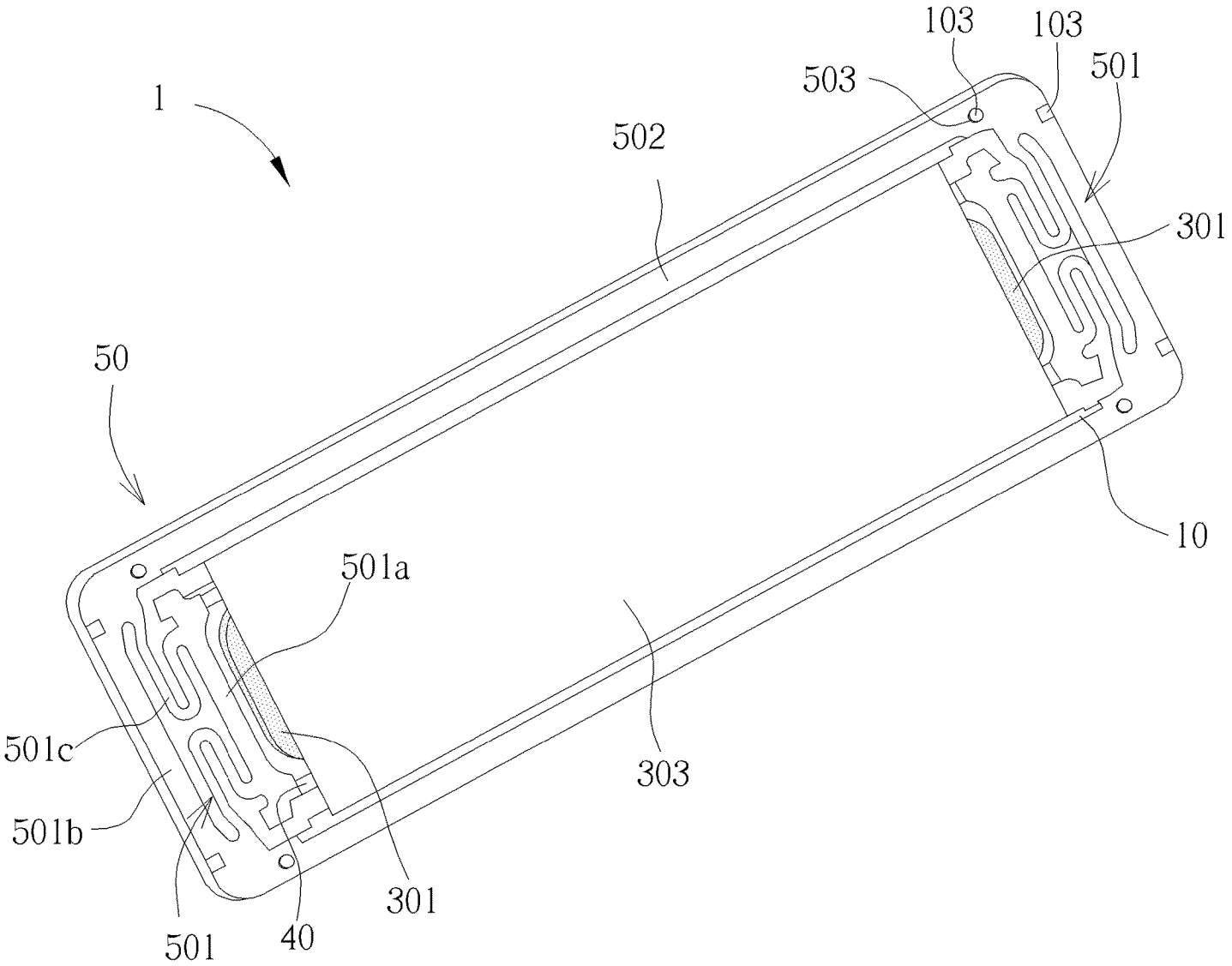
FIG. 1 is a schematic diagram showing the bottom of a micro-speaker according to an embodiment of the present invention.

In order to make the objectives, technical solutions, and advantages of the embodiments of the present invention clearer, the technical solutions in the embodiments of the present invention will be described clearly and completely in conjunction with the accompanying drawings in the embodiments of the present invention. Obviously, the described embodiments are part of the embodiments of the present invention, but not all of the embodiments. Based on the embodiments of the present invention, all other embodiments obtained by those of ordinary skill in the art without creative work shall fall within the protection scope of the present invention. Therefore, the following detailed description of the embodiments of the present invention provided in the accompanying drawings is not intended to limit the scope of the claimed invention, but merely represents selected embodiments of the present invention.

In the description of the present invention, it should be understood that the terms "center", "longitudinal", "transverse", 'length", "width", "thickness", "upper", "lower", "front", "back", "left", "Right", "vertical", "horizontal", "top", "bottom", "inner", "outer", "clockwise", "counterclockwise" and other directions or the positional relationship are based on the orientation or positional relationship shown in the drawings, and is only for the convenience of describing the present invention and simplifying the description, and does not indicate or imply that the pointed device or element must have a specific orientation, be constructed and operated in a specific orientation, Therefore, it shall not be interpreted as a limitation to the present invention.

In the present invention, unless otherwise clearly defined and specified, the "above" or "below" of the first feature of the second feature may include direct contact between the first and second features, or may include the first and second features not in direct contact but through other features between them. Moreover, "above", "above" and "above" the second feature of the first feature include the first feature being directly above and obliquely above the second feature, or it simply means that the first feature is higher in level than the second feature. The "below", "below" and "below" of the second feature of the first feature include the first feature directly below and obliquely below the second feature, or it simply means that the level of the first feature is smaller than the second feature.

Figure 2:
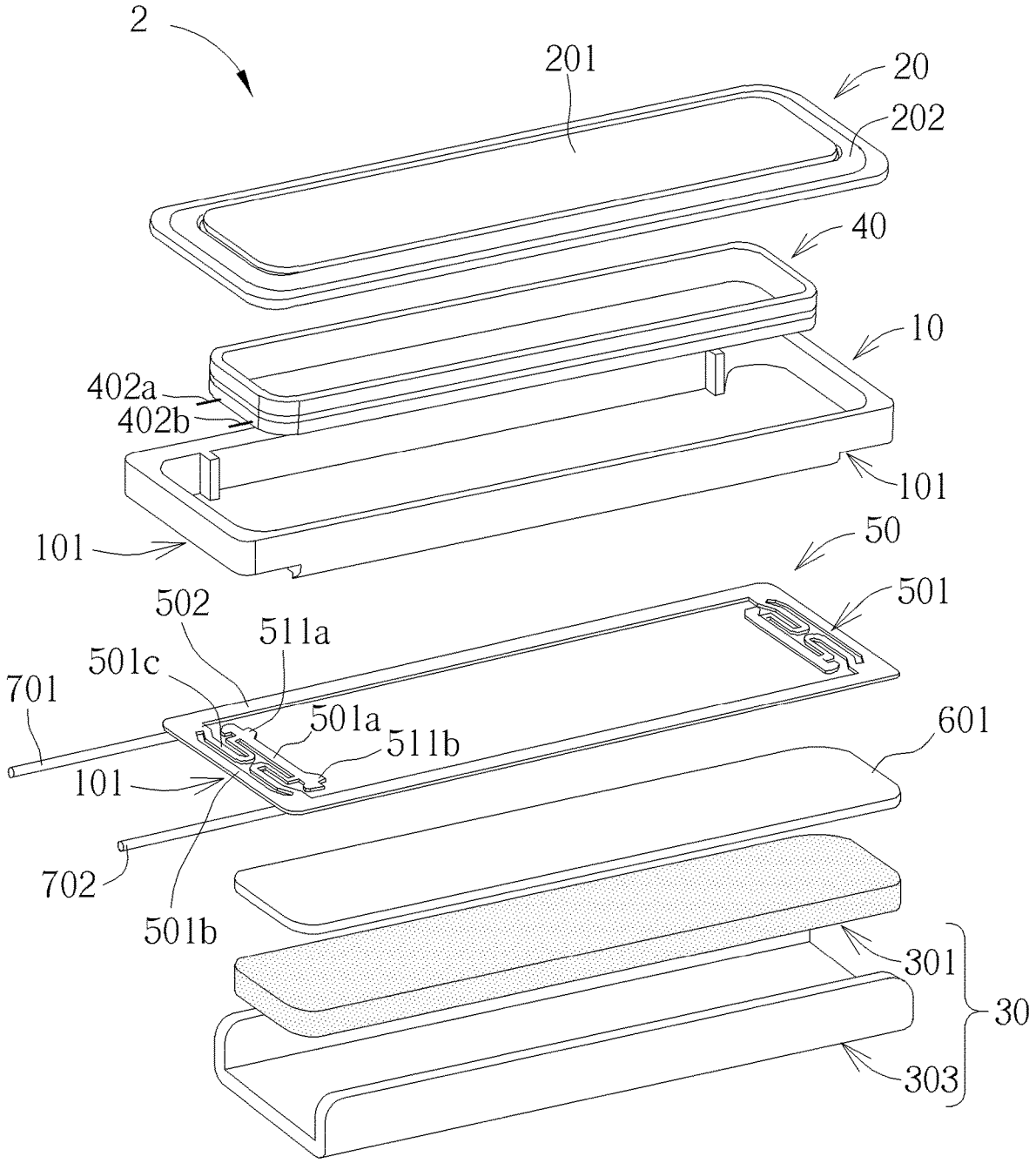
FIG. 2 is an exploded view of the micro speaker in FIG. 1.

Please refer to FIG. 1 and FIG. 2. FIG. 1 is a schematic diagram showing the bottom of a micro-speaker according to an embodiment of the present invention. FIG. 2 is an exploded view of the micro speaker in FIG. 1. As shown in FIG. 1 and FIG. 2, according to an embodiment of the present invention, the micro-speaker 1 includes a frame body 10 and a drum paper 20 provided on the frame body 10. According to an embodiment of the present invention, the drum paper 20 may include a diaphragm 201 and a surround 202. The surround 202 encircles the diaphragm 201 and has an arc-shaped or wavy-shaped cross-section. According to an embodiment of the present invention, the diaphragm 201 and the surround 202 may be composed of different materials, but are not limited thereto.

According to an embodiment of the present invention, preferably, the drum paper 20 is flexibly connected to the upper end of the frame body 10. According to an embodiment of the present invention, the diaphragm 201 may be arranged in a slender shape, that is, the size of the diaphragm 201 in the length direction is larger than the size in the width direction. According to an embodiment of the present invention, the frame body 10 has an opening that matches the shape of the drum paper 20 and the diaphragm 201, and the diaphragm 201 is connected to the frame body 10 through the ring-shaped surround 202 to seal the opening.

According to an embodiment of the present invention, the drum paper 20 may be a composite film with a sandwich structure, for example, a composite sandwich structure of polyether ether ketone (PEEK)/adhesive layer/PEEK, or a composite sandwich structure of thermoplastic polyester elastomer (TPEE)/adhesive layer/TPEE, but is not limited thereto. The adhesive layer can be acrylic glue, but is not limited thereto. According to another embodiment of the present invention, the drum paper 20 may be a single material, such as silicone resin, but is not limited thereto.

According to an embodiment of the present invention, a magnetic structure 30 is provided in the frame body 10, including a main magnetic portion 301 and a yoke 303 located below the main magnetic portion 301. According to an embodiment of the present invention, the magnetic circuit structure 30 is a single-magnet magnetic system, that is, no side magnetic parts are provided on both sides of the main magnetic part 301. According to an embodiment of the present invention, the cross section of the yoke 303 has a U-shaped profile. According to an embodiment of the present invention, the length of the yoke 303 is slightly shorter than that of the main magnetic portion 301 and the width of the yoke 303 is greater than that of the main magnetic portion 301. According to an embodiment of the present invention, a gap is provided between the main magnetic part 301 and the yoke 303. According to an embodiment of the present invention, a washer 601 for magnetic conduction is provided on the main magnetic portion 301.

According to an embodiment of the present invention, a voice coil 40 is provided in the frame body 10. According to an embodiment of the present invention, the voice coil 40 is formed by windings of insulated wire and does not require a bobbin. The voice coil 40 is disposed around the outer periphery of the main magnetic portion 301 and installed in the gap in a vertical direction. According to an embodiment of the present invention, the voice coil 40 is arranged in a slender shape, that is, the size of the voice coil 40 in the length direction is larger than the size in the width direction, and the upper end of the voice coil 40 is fixedly connected to the diaphragm 201. Preferably, in an embodiment of the present invention, the center of the voice coil 40 is located on the central axis of the diaphragm 201 in the longitudinal direction. A magnetic field is provided through the magnetic structure 30 to vibrate the voice coil 40 and drive the diaphragm 201 to vibrate and produce sound.

According to an embodiment of the present invention, a voice coil balancing system 50 is provided in the frame body 10, which is a one-piece structure composed of two symmetrically arranged dampers 501 and a support frame 502 integrally formed with the dampers 501. According to an embodiment of the present invention, the two dampers 501 are arranged below the two opposite ends of the long axis of the voice coil 40 and are integrally connected with the support frame 502 having a shape matching the shape of the frame body 10. The support frame 502 is fixed under the frame body 10 with glue or fixed under the frame body 10 by using an insert injection molding technique. According to an embodiment of the present invention, the dampers 501 and the support frame 502 are integrally formed by a flexible printed circuit (FPC).

Since the dampers 501 and the support frame 502 constitute a monolithic, one-piece voice-coil balancing structure, it is more convenient and simple to assemble, and the structure is more stable, so that the voice-coil balancing performance can be further improved. According to an embodiment of the present invention, the embedded iron or metal parts on the frame body 10 may be spared. In addition, in order to facilitate positioning, positioning bolts (or protrusions) 103 may be provided on the frame body 10 and a corresponding alignment hole 503 may be provided on the support frame 502.

According to an embodiment of the present invention, the damper 501 generally includes a first end 501*a*, a second end 501*b*, and a cantilever 501*c* connecting the first end 501*a* and the second end 501*b*. There are hollow parts between the first end 501*a*, the second end 501*b* and the cantilever 501*c*. The two dampers 501 are fixed to two recessed mounting portions 101 disposed under the two ends of the long axis of the frame body 10 by adjoining the second ends 501*b* to the recessed mounting portions 101 with glue. According to the embodiment of the present invention, the second end 501*b* may be directly connected to the support frame 502 or form a part of the support frame 502. The voice coil leads 402*a* and 402*b* are fixedly connected to the welding parts 511*a* and 511*b* of the first end 501*a* on the first side (the side facing the drum paper during assembly) (or the top side) of the damper 501, respectively, through spot welding. The welding parts 511*a* and 511*b* of the first end 501*a* on the first side of the damper 501 are electrically connected to the circuit on the second side (the side facing the yoke during assembly) (or bottom surface) of the damper 501 through conductive vias, which is further electrically connected to connection terminals 531*a*, 531*b* of the second end 501*b* on the second side of the damper 501.

According to an embodiment of the present invention, external signal wires 701 and 702 are then welded to the connection terminals 531*a*, 531*b* of the second end 501*b* on the second side of the damper 501, respectively, and connected to the external circuit to input the external audio signal through the damper 501, causing the diaphragm 201 to vibrate and produce sound.

According to an embodiment of the present invention, the dampers 501 and the support frame 502 are integrally formed by using a flexible circuit board. According to an embodiment of the present invention, most areas of the support frame 502 may be free of copper layers. A substrate of the support frame 502 may be composed of a polymer material. According to an embodiment of the present invention, only a specific area on the damper 501 is provided with a copper layer. According to an embodiment of the present invention, the support frame 502 is located outside the yoke 303.

Figure 3:
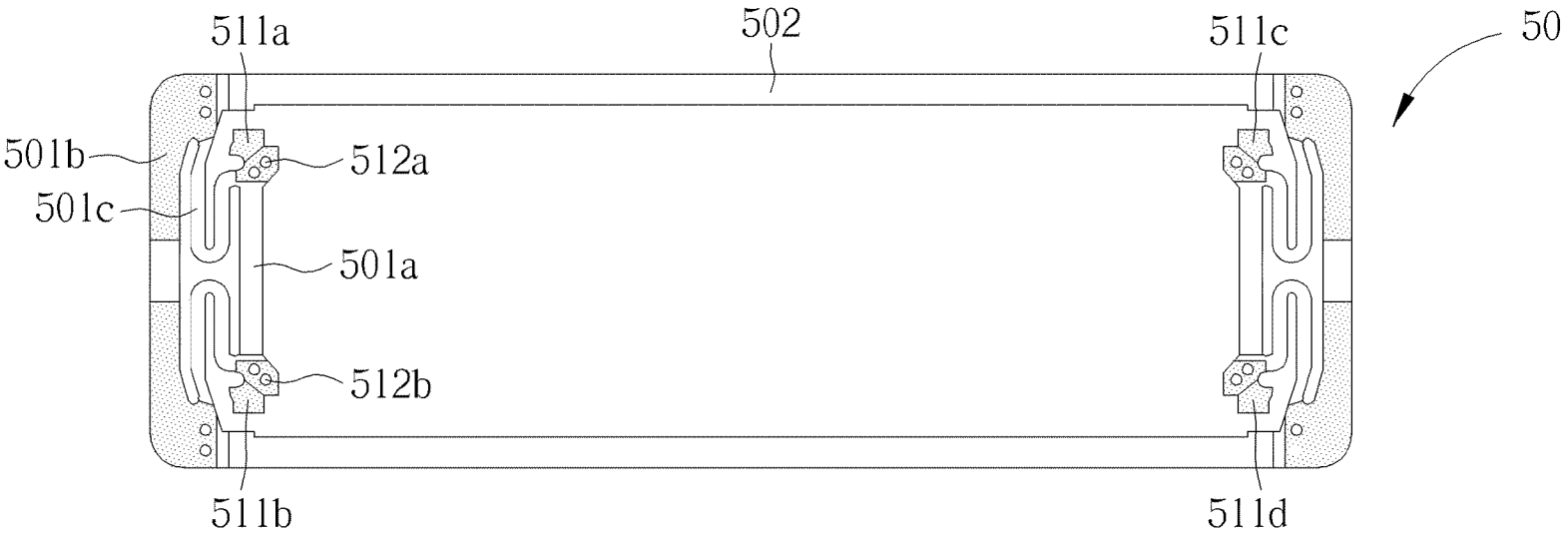
FIG. 3 illustrates a schematic diagram of the layout of the first surface of the damper.
Figure 4:
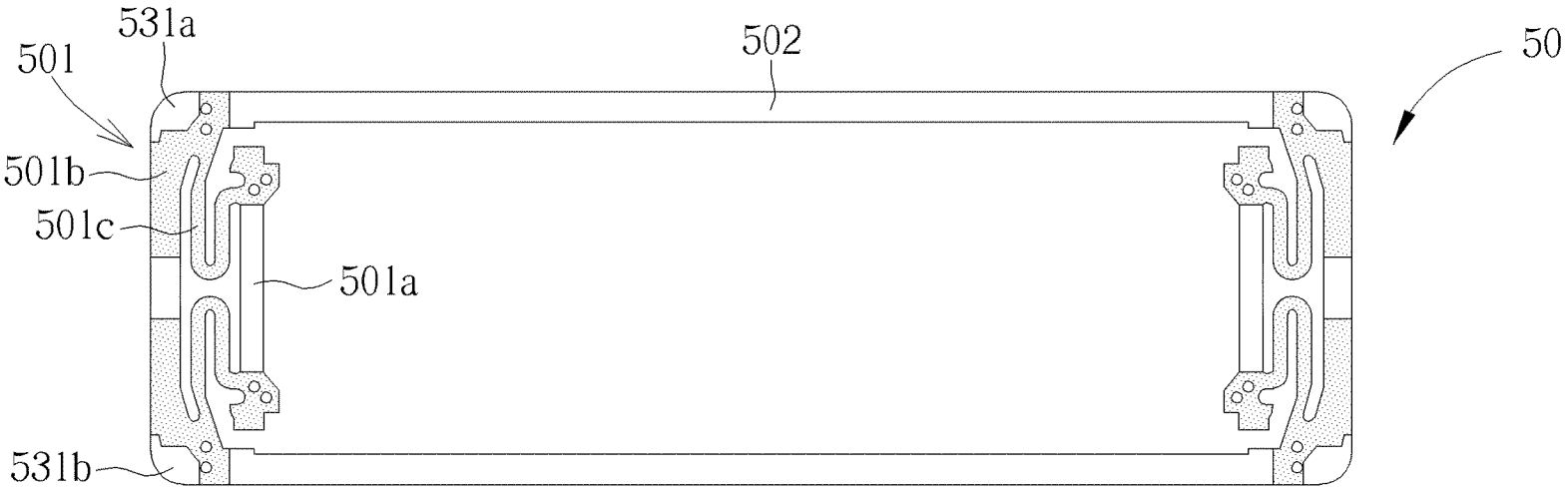
FIG. 4 illustrates a schematic diagram of the layout of the second surface of the damper.
Figure 5:
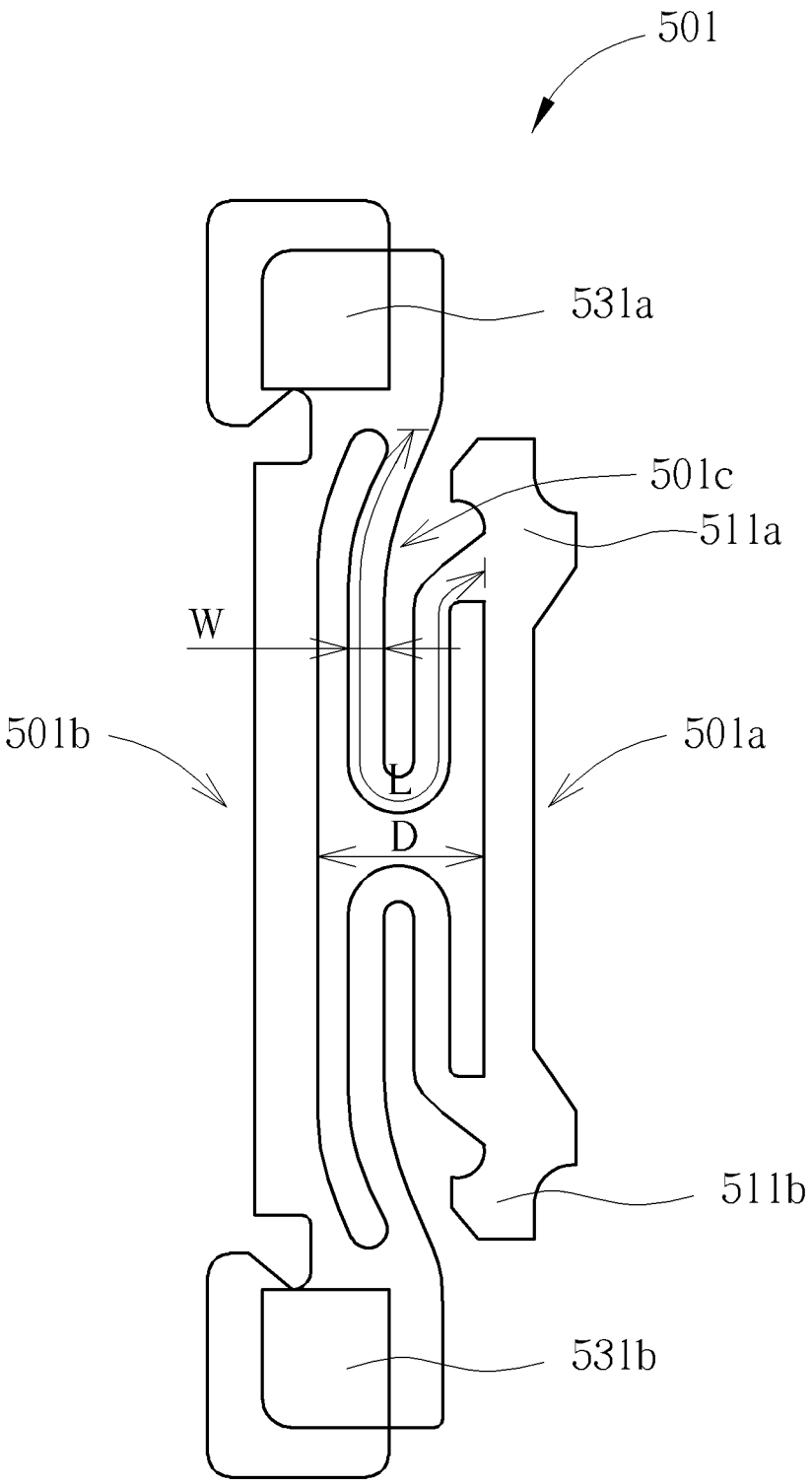
FIG. 5 shows the length L, width W and distribution distance D of the cantilever of the damper.

Please refer to FIG. 3 to FIG. 5. FIG. 3 illustrates the layout diagram of the first side (the side facing the drum paper during assembly) of the damper 501. FIG. 4 illustrates the layout diagram of the second side (the side facing the yoke during assembly) of the damper 501. FIG. 5 shows the length L, width W and distribution distance D of the cantilever 501*c* of the damper 501. As shown in FIG. 3 and FIG. 4, the damper 501 has a left-right symmetrical structure. In order to enable the FPC damper 501 to provide sufficient elasticity and damping, the cantilever 501*c* is not provided with a copper layer on the first side (or top side) of the damper 501. According to an embodiment of the present invention, the substrate of the damper 501 may be composed of a polymer material, such as polyimide resin, but is not limited thereto.

As shown in FIG. 3 and FIG. 4, the voice coil leads can be fixed to the welding parts 511*a* and 511*b* of the first end 501*a* on the top side of the damper 501 through spot welding, and then connected to the circuit on the second side of the damper 501 through the conductive vias 512*a* and 512*b*, respectively. That is, the cantilever 501*c* has a copper layer (the shaded part on the cantilever 501*c* in FIG. 4) only on the second side of the damper 501, which is electrically connected to the connection terminals 531*a* and 531*b* of the second end 501*b* on the bottom side. The aforementioned external signal wires 701 and 702 can be respectively welded to the connection terminals 531*a* and 531*b* of the second end 501*b* on the bottom side. According to an embodiment of the present invention, since the cantilever 501*c* has only a single-sided copper layer, sufficient elasticity and damping can be provided so that the micro-speaker 1 can pass the life test under high power operation.

One of the design features of FIG. 3 and FIG. 4 is that the positive and negative voice coil leads can be welded to the two ends of the damper 501 on the same side, respectively. In addition, taking FIG. 3 as an example, the positive voice coil lead can be welded to the welding part 511*a* or the welding part 511*b*, and the negative voice coil lead can be welded to the welding part 511*c* or the welding part 511*d* of the damper 501 at the other end of the monolithic, one-piece voice coil balancing system 50. One advantage of this is that the process window of welding the external signal wires is increased and the assembly process can have greater flexibility.

As shown in FIG. 5, the length L of the cantilever 501*c* refers to the length of the cantilever 501*c* extending between the first end 501*a* and the second end 501*b*, and the cantilever distribution distance D refers to the area width between the first end 501*a* and the second end 501*b* where the serpentine or curved cantilever 501*c* is distributed. According to an embodiment of the present invention, taking a cantilever width of 0.45 mm as an example, a ratio of the cantilever length L to the cantilever distribution distance D ranging between 2-15 is required.

Figure 6:
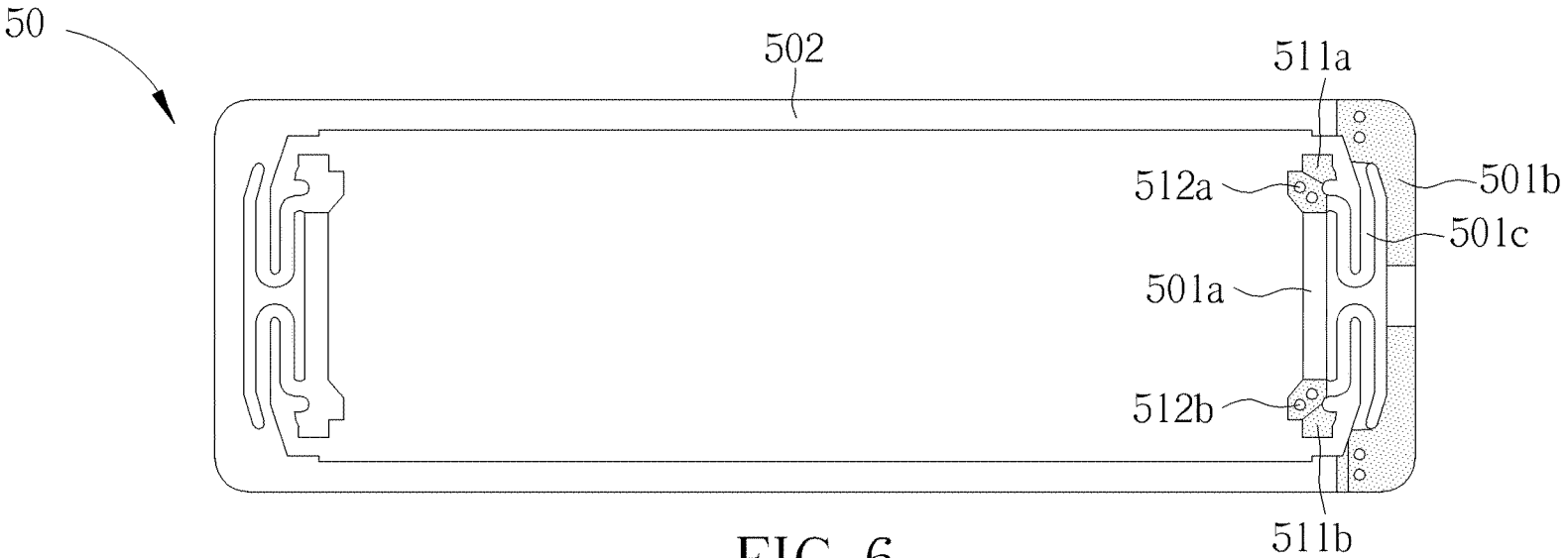
FIG. 6 and FIG. 7 are schematic diagrams of the layout of the first surface and the second surface of the damper, respectively, according to another embodiment of the invention.
Figure 7:
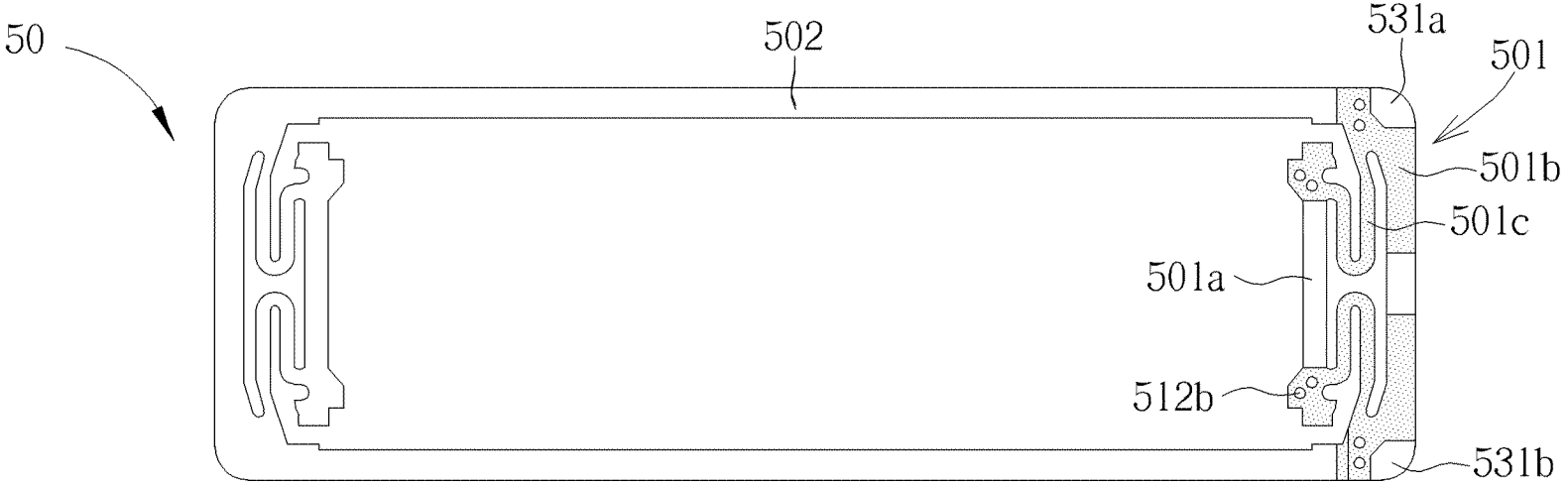

Please refer to FIG. 6 and FIG. 7. FIG. 6 and FIG. 7 are schematic diagrams showing the layout of the first side and the layout of the second side of the damper respectively according to another embodiment of the present invention. According to another embodiment of the invention, the copper layer may be provided only on a single side of the monolithic, one-piece voice coil balancing system 50. For example, in FIG. 6 and FIG. 7, only the damper 501 on the right side of the monolithic voice coil balancing system 50 is provided with a copper layer. The voice coil leads are fixed to the welding parts 511*a* and 511*b* (shaded part in FIG. 6) of the first end 501*a* of the right damper 501 through spot welding, and then electrically connected to the circuits (as shown in the shaded part in FIG. 7) of second side of the damper 501 through the conductive vias 512*a* and 512*b*, respectively. The circuits are electrically connected to the connection terminals 531*a* and 531*b* of the second end 501*b* of the right damper 501, respectively. The aforementioned external signal wires 701 and 702 can be respectively welded to the connection terminals 531*a* and 531*b* of the second end 501*b* of the right damper 501. In FIG. 6 and FIG. 7, no copper layer is provided on the left damper 501 and the support frame 502.

In addition, those skilled in the art should understand that although both sides of the monolithic, one-piece voice coil balancing system 50 in the drawings of the present application are symmetrical (the shape of the cantilever part is the same), it is only illustrative. In other embodiments, the design may also be asymmetrical. For example, the connection part with the frame body may be slightly changed according to different design requirements.

According to the embodiments of the present invention, a monolithic, one-piece voice coil balancing system 50 is provided as a medium, and the voice coil amplitude originally borne by the voice coil lead wire is shifted to the FPC damper 501. FPC damper 501 can provide enough elasticity and damping, so that the micro-speaker can also bear the amplitude brought by high power, thereby increasing the rated power (even in the case of reduced size, it can still provide large volume), and pass life test under high-power operation. In addition, the shape, style, and thickness of the FPC dampers 501 can be adjusted according to the vibration mode of the diaphragm 201, thereby making the vibration behavior of the micro-speaker more optimized to provide better sound quality. During the manufacturing process, the monolithic, one-piece voice coil balancing system 50 can be connected to the frame body 10 as a semi-finished product, which will simplify the complexity of the assembly and manufacturing process of the micro-speaker.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A micro-speaker, comprising: a frame body, a diaphragm arranged on the frame body, a magnetic structure and a voice coil arranged in the frame body, wherein an upper end of the voice coil is fixed to the diaphragm, the magnetic structure is arranged under the voice coil, and the micro-speaker is characterized in that an one-piece voice coil balancing system is fixed under the frame body, wherein the one-piece voice coil balancing system is composed of two symmetrically arranged dampers connected to an integrally formed support frame, wherein the two dampers and the support frame are made of a flexible circuit board, and wherein each of the dampers comprises a first end, a second end and a cantilever connecting the first end and the second end, and wherein a ratio of a length L of the cantilever to a distribution distance D of the cantilever is between 2-15, wherein a voice coil lead is fixed to a welding part of the first end on a front side of each of the two dampers by spot welding, which is electrically connected to a circuit on each of the two dampers and a connection terminal of the second end.

2. The micro-speaker according to claim 1, wherein each of the two dampers has a left-right symmetrical structure.

3. The micro-speaker according to claim 1, wherein the cantilever has no copper layer on a front side of each of the two dampers.

4. The micro-speaker according to claim 3, wherein each of the two dampers comprises a substrate that is made of a polymer material.

5. The micro-speaker according to claim 1, wherein an external signal wire is welded to the connection terminal of the second end.

6. The micro-speaker according to claim 1, wherein a width of the cantilever is 0.45 mm.

7. The micro-speaker according to claim 1, wherein the diaphragm is arranged in a slender shape, and wherein a size of the diaphragm in a length direction is larger than a size in a width direction.

8. The micro-speaker according to claim 7, wherein the frame body has an opening that matches a shape of the diaphragm, and the diaphragm is connected to the frame body through a ring-shaped surround to seal the opening.

9. The micro-speaker according to claim 1, wherein the magnetic structure includes a main magnetic portion and a yoke under the main magnetic portion, and wherein a gap is located between the main magnetic portion and the yoke, and the voice coil is disposed around an outer periphery of the main magnetic portion and installed in the gap.

10. The micro-speaker according to claim 9, wherein a washer for magnetic conduction is provided on the main magnetic portion.

11. The micro-speaker according to claim 9, wherein a cross-section of the yoke has a U-shaped profile.

12. The micro-speaker according to claim 9, wherein a length of the yoke is shorter than a length of the main magnetic portion and a width of the yoke is greater than a width of the main magnetic portion.

13. The micro-speaker according to claim 9, wherein the support frame is located outside the yoke.

14. The micro-speaker according to claim 1, wherein the support frame is fixed under the frame with glue.

15. The micro-speaker according to claim 1, wherein the support frame is fixed under the frame by insert injection molding.

16. The micro-speaker according to claim 1, wherein the frame body is provided with positioning bolts and the support frame is provided with corresponding alignment holes.

* * * * *